US005564885A

United States Patent [19]

Staben, Jr.

[11] Patent Number: 5,564,885

[45] Date of Patent: Oct. 15, 1996

[54] MULTIPURPOSE WORK ATTACHMENT FOR A FRONT END LOADER

[76] Inventor: Frank P. Staben, Jr., 2222 N. Rose, Oxnard, Calif. 93032

[21] Appl. No.: 461,686

[22] Filed: Jun. 5, 1995

[51] Int. Cl.[6] ..... E02F 3/28

[52] U.S. Cl. ..... 414/724; 414/912; 37/403

[58] Field of Search ..... 414/722, 723, 414/724, 912; 37/403–410, 468

[56] References Cited

U.S. PATENT DOCUMENTS

| | | | |
|---|---|---|---|
| 3,789,524 | 2/1974 | Mashuda | 414/722 X |
| 4,242,035 | 12/1980 | Hornstein | 414/724 |
| 4,372,063 | 2/1983 | Work | 414/912 X |
| 4,531,883 | 7/1985 | Arnold | 414/912 X |
| 5,403,144 | 4/1995 | Staben, Jr. . | |

*Primary Examiner*—Donald W. Underwood
*Attorney, Agent, or Firm*—Kelly Bauersfeld & Lowry

[57] ABSTRACT

An improved and versatile work attachment is provided for a front end loader of the type having hydraulically actuated frame arms for supporting and manipulating a work attachment at the front of the vehicle. The work attachment comprises a scoop or bucket in combination with a laterally extending row of ripper teeth mounted along a lower edge of the bucket and adapted for hydraulic actuation between an upper stored position and a downwardly extending deployed position for ripping earth upon vehicle movement in a reverse direction. In one form, the ripper teeth are used to retain and lock an auxiliary work attachment such as a fork lift unit onto the bucket. In another form, an hydraulically actuated grapple hook can be mounted onto the bucket for use in combination with the bucket and/or fork lift unit.

13 Claims, 4 Drawing Sheets

108
76
62
12
108
72
48
64
52
54
76
110
72
16
52
67
66
16
84
90
96
98
88
92
96
98
86
82

MULTIPURPOSE WORK ATTACHMENT FOR A FRONT END LOADER

BACKGROUND OF THE INVENTION

This invention relates generally to improvements in so-called front end loaders of the type having an hydraulically operated frame for supporting and manipulating a bucket or scoop or other work attachment at the front of the vehicle. More specifically, this invention relates to improvements in work attachments for use with a front end loader, particularly with respect a multipurpose work attachment adapted for performing a multitude of different tasks. The invention is particularly suited for use with relatively small so-called skid-steer front end loaders of the general type described in U.S. Pat. Nos. 3,231,117 and 3,672,521.

Front end loaders are generally known in the art for use in performing a wide range of grading, digging, construction, and other related tasks. In general terms, the front end loader typically comprises a tractor-type vehicle equipped with a pivoting frame having a selected work attachment such as a scoop or bucket connected thereto. Hydraulic actuator units are provided on the vehicle for controlled raising and lowering of the pivoting frame, in combination with controlled fore-aft pitch adjustment of the work attachment. Appropriate manipulation of the hydraulic actuater units enables the work attachment to be correspondingly manipulated to perform a specific desired task.

An exemplary front end loader is shown and described in U.S. Pat. No. 3,231,117, generally in conformance with so-called skid-steer front end loaders marketed by Melroe Company, Division of Clark Equipment Co., Fargo, North Dakota, under the trademark BOBCAT. Such front end loaders are adapted for relatively rapid and interchangeable mounting of different work attachments, such as scoops or buckets, dozer blades, fork lift apparatus, rotary sweepers, jackhammer and auger devices, etc. In this regard, front end loaders of this type are frequently equipped with an adapter mounting plate of type described in U.S. Pat. No. 3,672,521 to facilitate rapid interchanging of work attachments. U.S. Pat. No. 5,403,144 describes an improved adapter mounting plate for controlled lateral tilt adjustment of the work attachment, such as a bucket or scoop, mounted thereto.

In the past, work attachments for front end loaders have generally been designed to perform one or a small number of specific or related tasks. When it is desired to use the front end loader to perform a task of significantly different character, it has been necessary to remove the work attachment presently in use, and to replaced that work attachment with a different one better suited to the new task. For example, a bucket or scoop must removed from the front end loader and replace by a different work attachment, such as a fork lift unit, in accordance with the new task to be performed. Although interchange of work attachments is not necessarily a complicated procedure, at least some time is required to effect the attachment interchange, resulting in a time interval when the front end loader cannot be used to perform a desired work activity.

The present invention is directed to an improved work attachment designed for multipurpose functions and further adapted for rapid mounting of auxiliary attachment devices for the performance of still further work activities.

SUMMARY OF THE INVENTION

In accordance with the invention, a multipurpose work attachment is provided for mounting onto hydraulically actuated frame arms at the front end of a front end loader. In the preferred form, the work attachment comprises a bucket or scoop adapted for mounting onto an adapter mounting plate carried by the vehicle frame arms. A plurality of pivotally movable ripper teeth are mounted in a laterally extending row along a lower rear edge of the bucket for hydraulic actuation between an upper stored position and a downwardly extending deployed position.

When the ripper teeth are disposed in the upper stored position, the bucket can be operated and manipulated in a conventional manner. When the ripper teeth are in the downwardly extending deployed position, the ripper teeth can be used to engage and rip the ground upon vehicle movement in a rearward direction.

The multipurpose work attachment, as described, is conveniently adapted for quick and easy mounting of auxiliary work attachments, without requiring dismounting of the bucket from the vehicle. In one form, the auxiliary work attachment comprises a fork lift unit having fork tines projecting forwardly from a base frame. The base frame includes a retainer bar adapted to fit over and engage a front edge of the bucket, in combination with rearwardly projecting lock arms having lock ports formed therein. At least one and preferably a plurality of the ripper teeth are received through these lock ports while in the deployed position, whereupon the ripper are moved to the stored position for lockingly engaging the lock arms and thereby securing the base frame onto the bucket.

In a further alternative form, the bucket is equipped with mounting brackets for pivotally supporting a grapple hook at the top of the bucket. Hydraulical actuators can be mounted a rear side of the bucket for pivotally opening and closing the grapple hook relative the bucket and/or any auxiliary work attachment such as a fork lift unit mounted thereto.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
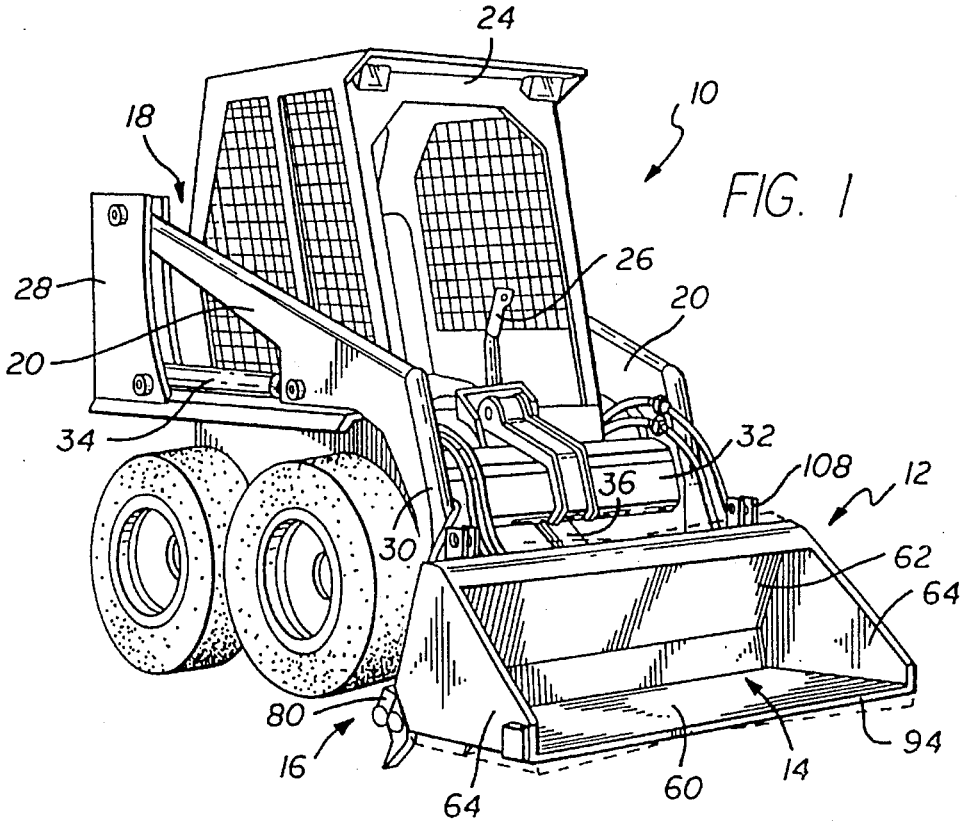
FIG. 1 is a perspective view illustrating a front end loader equipped with a multipurpose work attachment constructed in accordance with the present invention.

As shown in the exemplary drawings, a front end loader referred generally in FIG. 1 by the reference numeral 10 includes a removably mounted multipurpose work attachment 12 for performing a variety of different tasks. As shown, the work attachment 12 comprises a primary implement such as a forwardly open scoop or bucket 14, in combination with a secondary implement comprising a laterally extending row of ripper teeth 16. The attachment 12 is adapted for mounting onto a vehicle lift frame 18 including hydraulically actuated lift arms 20. The front end loader additionally includes a blade tilt assembly 22 (FIG. 2) for manipulating the work attachment.

The illustrative front end loader 10 generally comprises a power-driven vehicle having an operator's cab 24 with suitable controls 26 for driving and steering the vehicle, and for manipulating the work attachment 12 for performing a selected task or tasks. In this regard, FIG. 1 shows the vehicle to include the lift frame 18 defined by the pair of lift arms 20 which extend along opposite sides of the vehicle from a pivot base 28 to front lower ends 30 for connection to the work attachment. The lift arms 20 are typically interconnected at the front of the vehicle by a cross brace 32. Each lift arm 20 is associated with an hydraulic lift unit 34, one of which is shown in FIG. 1, for raising and lowering the frame 18 and the work attachment 12 connected thereto, all in a manner known to persons skilled in the art. In addition, an hydraulic pitch control unit 36 is connected between the vehicle and the work attachment 12 to permit operator selection of the fore-aft pitch orientation of the work attachment. The illustrative front end loader, as described above, corresponds generally with the front end loader shown and described in U.S. Pat. No. 3,231,117, which is incorporated by reference herein. Such front end loaders are generally referred to as skid-steer loaders, and are commercially available under the trademark BOBCAT, from Melroe Company, Division of Clark Equipment Co., Fargo, N.D.

Figure 2:
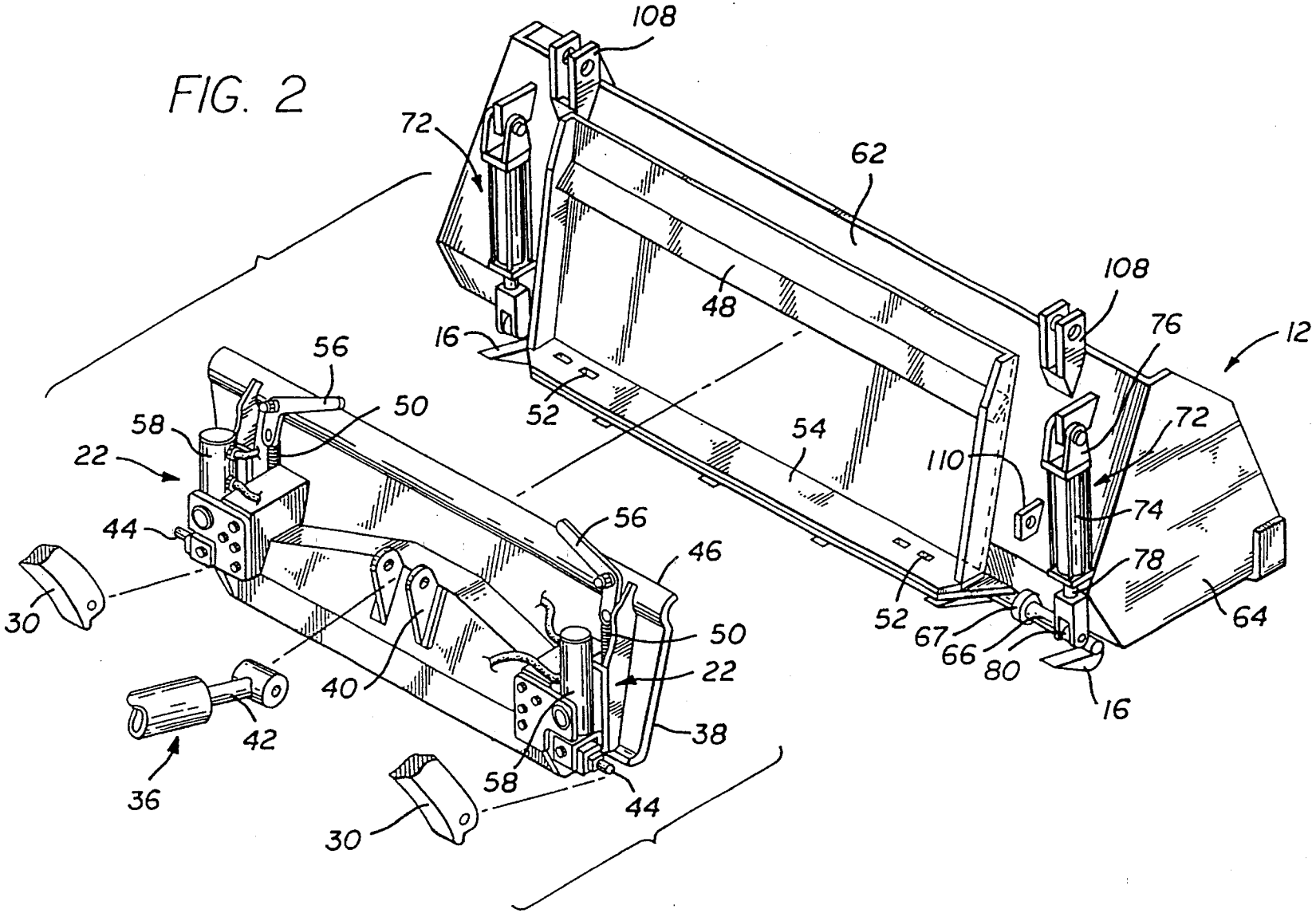
FIG. 2 is an enlarged fragmented and exploded rear perspective view illustrating removable mounting of the work attachment onto an adapter mounting plate at the front of the vehicle.

Removable mounting of the work attachment 12 is facilitated by use of an adapter mounting plate 38, as shown in FIG. 2. More particularly, FIG. 2 illustrates the adapter mounting plate in the form of a generally rectangular base structure having a clevis 40 positioned centrally on a rear side thereof for connection to an extensible ram 42 of the pitch control unit 36. A pair of transversely extending and generally coaxially oriented link pins 44 project outwardly from the lower, laterally opposed ends of the mounting plate 38, at a location below the clevis 40, to provide a pivot connection for the front lower ends 30 of the lift arms 20. An angularly set upper margin 46 of the mounting plate 38 has a size and shape to nest beneath an angularly set retainer bracket 48 formed on a rear face of the work attachment 12. When the upper margin 46 of the adapter mounting plate 38 is nested within the retainer bracket 48, spring-loaded lock pins 50 are receivable into lock ports 52 on a lower shelf 54 at the rear of the work attachment. The lock pins 50 can be retracted from the lock ports 52, by means of pivotal release levers 56, to accommodate relatively rapid disassembly of the work attachment 12 from the adapter mounting plate 38. The above-described connection structure for removably mounting the work attachment onto the adapter mounting plate 38 is described in more detail in U.S. Pat. No. 3,672,521, which is also incorporated by reference herein.

FIG. 2 additionally shows a pair of hydraulic tilt units 58 mounted on the rear side of the adapter mounting plate 38 at the opposite ends thereof. These hydraulic tilt units 58 form the blade tilt assemblies 22 and adjustably interconnect the lift arms 20 to the mounting plate 38 in a manner permitting bidirectional tilt adjustment of the work attachment. The specific construction and functional operation of these hydraulic tilt units 58 are described in more detail in U.S. Pat. No. 5,403,144, which is incorporated by reference herein.

FIGS. 1 and 2 shown the multipurpose work attachment 12 in the form a forwardly open scoop or bucket for performing various tasks such as moving and/or hauling dirt, etc. In general terms, the bucket is defined by a generally horizontally extending floor plate 60 joined at a rear edge to an upstanding rear wall 62 and at opposite sides to a pair of side walls 64.

In accordance with one primary aspect of the invention, the bucket attachment additionally includes the laterally extending row of ripper teeth 16 carried at the lower rear edge of the bucket on a laterally extending pivot shaft 66 mounted at the lower edge of the bucket by suitable bearing blocks 67 or the like. The ripper teeth 16 each include smoothly contoured leading edges 68 (FIGS. 3 and 4) and relatively sharp end points 70. The ripper teeth are adapted for movement together upon rotation of the pivot shaft 66 to an elevated or upper storage position as viewed in FIG. 4, with the curved leading edges 68 presented downwardly, and with the ripper teeth disposed generally above the plane of the bucket floor plate 60. Conversely, the pivot shaft 66 is rotatable to displace the ripper teeth 16 to a downwardly extending or deployed position, as viewed in FIG. 3, with the end points 70 of the teeth 16 disposed substantially below the bucket floor plate 60. In the deployed orientation, the ripper teeth 16 are disposed for ripping ground upon reverse direction travel of the vehicle 10, with the bucket positioned generally at ground level.

Figure 3:
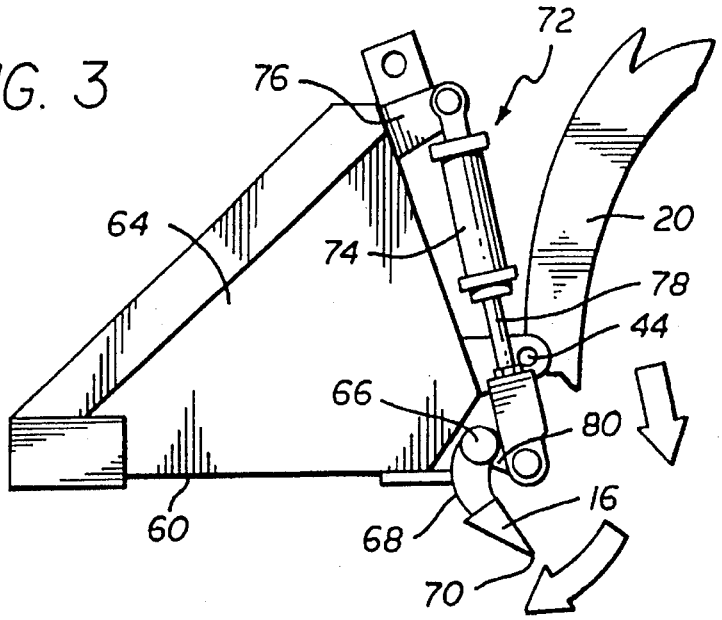
FIG. 3 is an enlarged fragmented side elevational view depicting the work attachment of FIGS. 1 and 2, with ripper teeth oriented in a downwardly extending deployed position.
Figure 4:
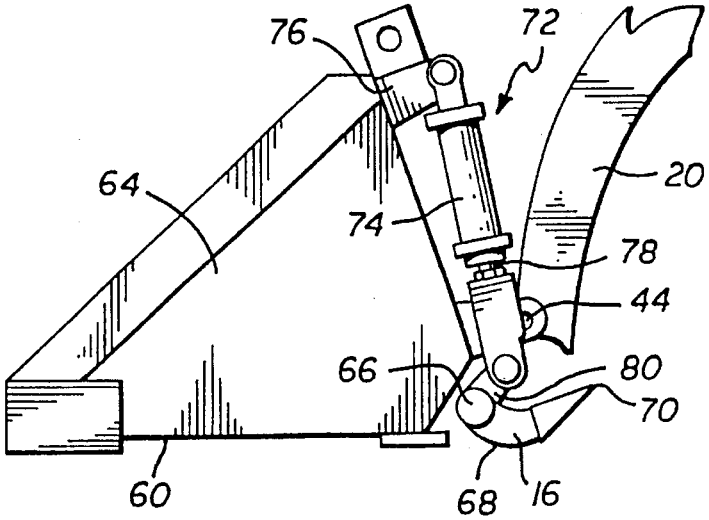
FIG. 4 is a fragmented side elevational view similar to FIG. 3, and depicting the ripper teeth in an upper stored position.

Ripper teeth rotation is achieved by a pair of hydraulic actuators 72 each including a cylinder 74 mounted on a bracket plate 76 at the rear of the bucket, and an extensible ram 78 connected to a crank link 80 of the pivot shaft 66. As shown in FIGS. 3 and 4, extension of the rams 78 of the hydraulic actuators 72 moves the ripper teeth 16 to the deployed position, whereas retraction of the rams 78 moves the ripper teeth 16 to the upper stored position. Importantly, the inclusion of the ripper teeth 16 as part of the work attachment 12 uniquely adapts the work attachment for multipurpose or multitask uses.

Figure 6:
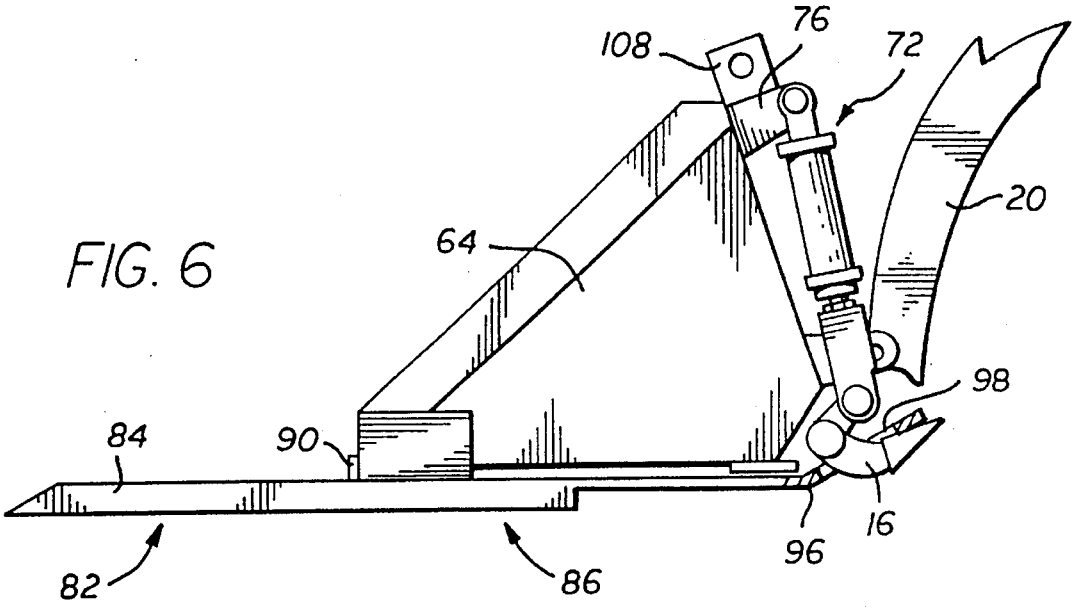
FIG. 6 is a fragmented side elevational view similar to FIGS. 3 and 4, but depicting the multipurpose work attachment assembled with the auxiliary work attachment of FIG. 5.
Figure 5:
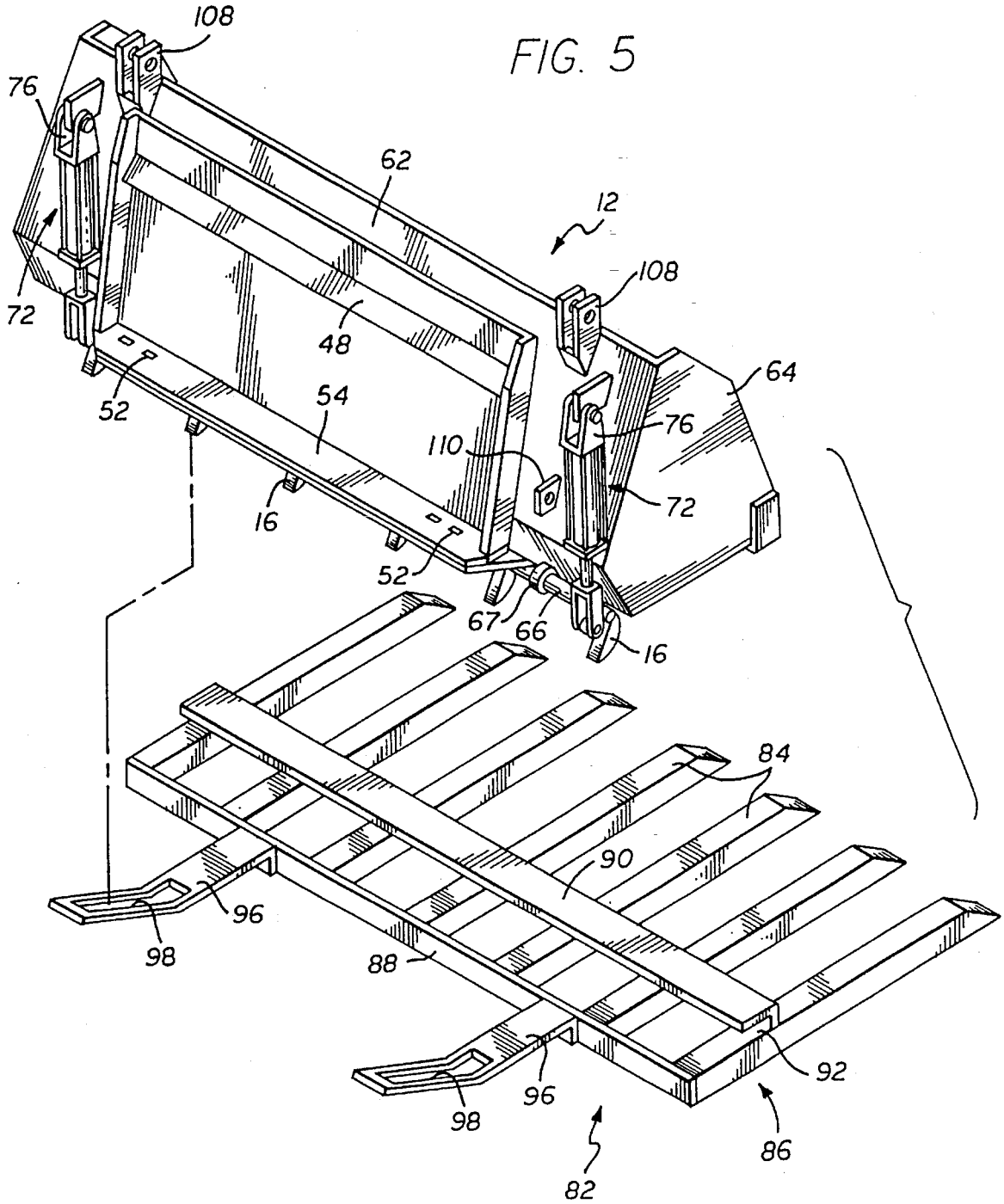
FIG. 5 is an exploded perspective view illustrating the multipurpose work attachment in combination with an auxiliary work attachment such as a fork lift unit.

In addition, the inclusion of the ripper teeth 16 also facilitates rapid assembly of an auxiliary work attachment 82 to the bucket, without requiring bucket dismounting from the adapter mounting plate 38, as viewed in FIGS. 5 and 6. More specifically, as shown in one preferred form, the auxiliary work attachment 82 comprises a fork lift unit having a plurality of forwardly projecting fork tines 84 interconnected at their rear ends by a base frame 86 including a rear cross bar 88 and a retainer bar 90. The retainer bar 90 extends transversely across the fork tines 84 at a position spaced forwardly from the rear cross bar 88, and the retainer bar 90 defines a rearwardly open channel 92 for slide-fit reception of a forward margin 94 (FIG. 1) of the bucket floor plate 60. In this position, as shown in FIG. 6, a plurality of rearwardly projecting lock arms 96 having lock ports 98 formed therein are disposed with said lock ports 98 underlying a corresponding number of the ripper teeth 16. In the illustrative drawings, two lock arms 96 are shown for underlying a pair of the ripper teeth 16, although it will be understood that any selected number of the lock arms 96 may be provided. Importantly, the ripper teeth 16 are received downwardly through the lock ports 98 by first orienting the ripper teeth in the deployed position as viewed in FIG. 3, operating the bucket to mount the front margin 94 within the retainer bar channel 92, and then operating the hydraulic actuators 72 to shift the ripper teeth 16 to the stored position as viewed in FIGS. 4 and 6. When the auxiliary work attachment 82 is assembled with the bucket, this movement of the ripper teeth effectively causes the ripper teeth to engage and lock with the lock arms 96, thereby securely retaining the auxiliary work attachment on the bucket.

The assembled work attachment 12 and the related auxiliary work attachment 82, as viewed in FIG. 6, can be utilized to perform a variety of additional tasks, all without requiring disassembly of the basic multipurpose work attachment 12 from the front end loader. Thus, the overall versatility and utility of the vehicle is enhanced without time delays involved in removably mounting different work attachments to the adapter mounting plate 38.

Figure 7:
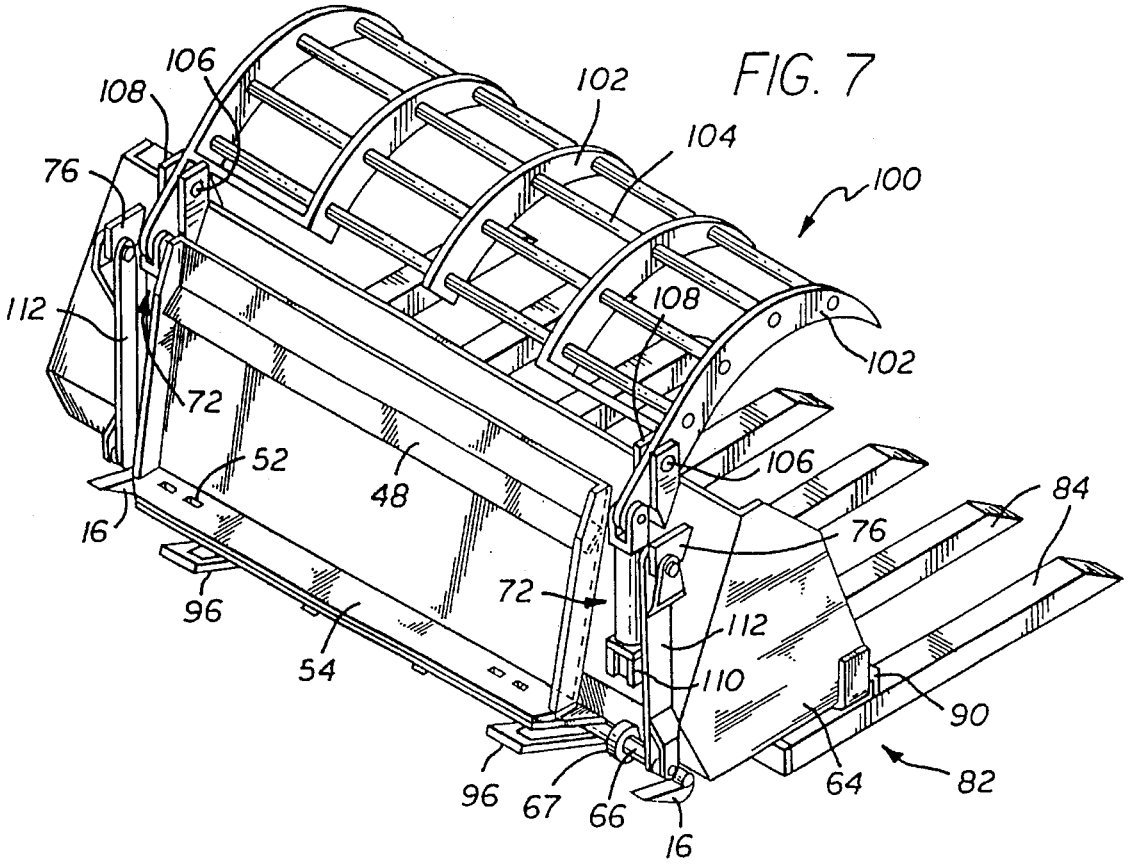
FIG. 7 is a rear perspective view illustrating a further embodiment of the invention, including a grapple hook mounted onto the multipurpose work attachment.

FIG. 7 illustrates a further adaptation of the multipurpose work attachment to include a pivotally mounted grapple hook 100. As shown, in this embodiment, the grapple hook comprises a plurality of forwardly and downwardly curved hooks 102 interconnected by lateral cross bars 104, with the hooks at opposite ends being connected by pivot pins 106 to an upstanding pair of pivot brackets 108 formed on the rear wall 62 of the bucket. These pivot brackets 108 support the grapple hook for assembly with the hydraulic actuators 72 which can be coupled between the grapple hook 100 and lower mounting brackets 110 on the bucket. In this regard, the hydraulic actuators 72 can be disassembled from operative connection with the pivot shaft 66 and the ripper teeth 16, and used instead for hydraulically operating the grapple hook 100. When the hydraulic actuators 72 are used in this manner, it is desirable to use fixed length links 112 coupled between the brackets 76 and the pivot shaft 66 to retain the ripper teeth 16 in the upper stored position. Alternately, if desired, the actuators 72 may remain in operative connection with the ripper teeth 16, with additional hydraulic actuater units employed to operate the grapple hook 100. In either case, the grapple hook 100 may be used in combination with the bucket, or additionally in combination with the auxiliary work attachment 82 such as the; fork lift unit as shown in FIG. 7. Once again, the overall versatility and utility of the work attachments are enhanced without requiring disassembly of the primary work attachment 12 from the front end loader.

A variety of further modifications and improvements to the improved multipurpose work attachment for a front end loader of the present invention will be apparent to those skilled in the art. Accordingly, no limitation on the invention is intended by way of the foregoing description and the accompanying drawings, except as set forth in the appended claims.

What is claimed is:

1. A multipurpose work attachment for a front end loader, comprising:

a primary implement;

means mounted on said primary implement for connecting said primary implement to a lift frame of a front end loader;

a secondary implement carried by said primary implement;

means mounted between said primary and secondary implements for moving said secondary implement between first and second positions relative to said primary implement; and an auxiliary implement mounted onto said primary implement, said auxiliary implement being removable from said primary implement when said secondary implement is in the first position, said secondary implement being movable to said second position to releasably lock said auxiliary implement onto said primary implement.

2. The multipurpose work attachment of claim 1 wherein said primary implement comprises a forwardly open bucket.

3. The multipurpose work attachment of claim 2 wherein said secondary implement comprises a laterally extending pivot shaft rotatably supported generally at a lower rear edge of said bucket and carrying a plurality of ripper teeth, said pivot shaft being rotatable relative to said bucket for moving said ripper teeth between said first and second positions.

4. The multipurpose work attachment of claim 3 wherein said auxiliary implement comprises a base frame removably mounted onto said bucket, said base frame including at least one lock arm having a lock port formed therein, one of said ripper teeth being receivable through said lock port when said auxiliary implement is mounted onto said bucket.

5. The multipurpose work attachment of claim 4 wherein said base frame comprises a retainer bar defining a rearwardly open channel for receiving a front edge of said bucket.

6. The multipurpose work attachment of claim 5 wherein said auxiliary implement comprises a fork lift unit having a plurality of parallel tines projecting from said base frame.

7. The multipurpose work attachment of claim 4 wherein said means for moving said secondary implement comprises at least one hydraulic actuator mounted on said bucket.

8. The multipurpose work attachment of claim 4 further including a grapple hook, means mounted between said grapple hook and said bucket for pivotally mounting said grapple hook onto said bucket, and means mounted between said grapple hook and said bucket for moving said grapple hook between open and closed positions relative to said bucket.

9. The multipurpose work attachment of claim 8 wherein said grapple hook is mounted onto said bucket independently of said auxiliary implement.

10. A multipurpose work attachment for a front end loader, comprising:

a bucket;

means mounted on said bucket for mounting said bucket onto a lift frame of a front end loader;

a pivot shaft extending laterally across and rotatably supported relatively to a lower edge of said bucket;

a plurality of ripper teeth carried by said shaft for movement upon shaft rotation between a stored position and a deployed position;

means mounted between said shaft and said bucket for rotating said shaft to move said ripper teeth between the stored and deployed positions; and an auxiliary attachment having a base frame with a retainer bar defining a rearwardly open channel for slide-fit reception of a front edge of said bucket, and at least one rearwardly projecting lock arm having a lock port formed therein, one of said ripper teeth being receivable through said lock port when said ripper teeth are in the deployed position, said one ripper tooth locking said auxiliary attachment onto said bucket when said ripper teeth are in the stored position.

11. The multipurpose work attachment of claim 10 wherein said means for rotating said shaft comprises at least one hydraulic actuator.

12. The multipurpose work attachment of claim 10 wherein said auxiliary attachment comprises a fork lift unit having a plurality of parallel tines projecting from said base frame.

13. The multipurpose work attachment of claim 10 further including a grapple hook, means mounted between said grapple hook and said bucket for pivotally mounting said grapple hook onto said bucket, and means mounted between said grapple hook and said bucket for moving said grapple hook between open and closed positions relative to said bucket.

* * * * *